US006145351A

United States Patent [19]

Levenson

[11] Patent Number: 6,145,351

[45] **Date of Patent: *Nov. 14, 2000**

[54] PERIMETER SECURITY SYSTEM WITH IMPROVED Z-BAR LOCK FOR MAXIMUM DEGREE OF MECHANICAL AND ELECTRONIC PROTECTION

[75] Inventor: Alvin S. Levenson, Upperco, Md.

[73] Assignee: The Brooke-Duveen Group, Ltd., Baltimore, Md.

[ * ] Notice: This patent is subject to a terminal disclaimer.

[21] Appl. No.: 09/336,876

[22] Filed: Jun. 18, 1999

[51] Int. Cl.[7] ..... E05C 17/32

[52] U.S. Cl. ..... 70/93; 292/263; 292/272; 292/304; 292/341.17

[58] Field of Search ..... 70/73, 83, 93, 70/125, 128, 130, DIG. 12, DIG. 79, DIG. 49; 292/263, 304, 272, 341.15, 341.17

[56] References Cited

U.S. PATENT DOCUMENTS

| | | | |
|---|---|---|---|
| 1,029,693 | 6/1912 | Klein . | |
| 1,174,629 | 3/1916 | Slauson | 292/341.15 |
| 1,358,885 | 11/1920 | Shimocuskies | 292/341.15 |
| 1,896,909 | 2/1933 | Maxwell | 292/341.17 |
| 2,062,020 | 11/1936 | Engel | 70/93 |
| 2,174,890 | 10/1939 | Lipiner | 70/93 |
| 2,205,156 | 6/1940 | Rowley . | |
| 2,407,900 | 9/1946 | Paul . | |
| 2,452,151 | 10/1948 | Robins | 70/93 |
| 2,772,110 | 11/1956 | Petrochko | 292/341.17 |
| 2,784,023 | 3/1957 | Pisani | 292/341.15 |
| 3,004,419 | 10/1961 | Falk, Jr. | 70/93 |
| 3,873,142 | 3/1975 | Reid | 292/66 |
| 3,924,885 | 12/1975 | Markovitch | 292/262 |
| 3,924,886 | 12/1975 | Markovitch | 292/262 |
| 3,924,887 | 12/1975 | Markovitch | 292/283 |
| 4,580,820 | 4/1986 | Baber | 292/341.17 X |
| 5,244,240 | 9/1993 | Nordmeyer et al. | 292/263 |
| 5,771,720 | 6/1998 | Levenson | 70/93 |

FOREIGN PATENT DOCUMENTS

| | | | |
|---|---|---|---|
| 755067 | 11/1933 | France | 292/341.17 |

*Primary Examiner*—Lloyd A. Gall
*Attorney, Agent, or Firm*—Leonard Bloom

[57] ABSTRACT

A Z-bar security system, one which is provided with a key and a secured latch, is combined with an electronic alarm and monitoring system. This combination provides the maximum degree of both mechanical and electronic security. In a preferred embodiment, a Z-bar latch assembly has a three-position rotatable cylinder which is operable by a key from outside of the door. These three positions correspond, respectively, to "open", "viewing" and "closed" positions of the door.

39 Claims, 10 Drawing Sheets

76
82
70
68
72
24
12
77
74
26
28
32
20
33
38
30
40
36
52
56
33
22
54
26
18
40
10
48
50
46
44
42

PERIMETER SECURITY SYSTEM WITH IMPROVED Z-BAR LOCK FOR MAXIMUM DEGREE OF MECHANICAL AND ELECTRONIC PROTECTION

CROSS REFERENCE TO RELATED APPLICATION

The present invention constitutes an improvement on my U.S. Pat. No. 5,771,720, entitled "Z-Bar Security System With Key and Secured Latch", issued on Jun. 30, 1998 on an application filed on Mar. 26, 1996, the contents of which are incorporated by reference herein in their entirety.

My aforesaid '720 patent, which is assigned to the assignee of the present invention, relates to door locks, and more particularly to a door lock that can: lock the door shut in dead bolt fashion from the inside of the door, lock the door in a dead bolt fashion from the outside of the door using a key, allow the door to open a limited distance, allow the door to open freely, and lock the door from the inside in such a fashion that a person on the outside with a key cannot gain access.

FIELD OF THE INVENTION

The present invention relates to a perimeter security system, and more particularly, to an electronic alarm in combination with an improved Z-bar lock, thereby providing a maximum degree of mechanical and electronic security.

BACKGROUND OF THE INVENTION

Many doors, such as household doors, are provided with a dead bolt lock in order to maintain security by bolting the door shut. The dead bolts are normally required to extend one inch into the door frame and associated latch plate. Unfortunately, the dead bolt must be released and the door opened in order to (1) pass a small object through the doorway, such as an envelope or small package, or (2) to view the persons outside the door. While a short chain may be used to prevent the door from fully opening, such a chain arrangement is often weak and provides poor security.

Other devices to secure a door or to permit partial opening of a door are disclosed in the following:

| U.S. Pat. No. | Inventor(s) |
|---|---|
| 1,029,693 | Klein |
| 2,407,900 | Paul |
| 3,924,885 | Markovitch |
| 3,924,886 | Markovitch |
| 3,924,887 | Markovitch |

Additional prior art, of which I am aware, is as follows:

| U.S. Pat. No. | Inventor(s) |
|---|---|
| 1,174,629 | Slauson |
| 1,358,885 | Shimocuskies |
| 1,896,909 | Maxwell |
| 2,062,020 | Engel |
| 2,174,890 | Lipiner |
| 2,452,151 | Robins |
| 2,772,110 | Petrochko |
| 2,784,023 | Pisani |

-continued

| U.S. Pat. No. | Inventor(s) |
|---|---|
| 3,004,419 | Falk, Jr. |
| 4,580,820 | Baber |

An alternative to a standard dead bolt lock is a lock that can operate either in a mode similar to a dead bolt or as a latch having a Z-Bar configuration, which allows the door to open a limited distance.

Such a lock is disclosed in my earlier U.S. Pat. No. 5,244,240. In my '240 patent, which is assigned to the assignee of the present invention, the lock can alternatively: (1) lock the door in dead bolt fashion, (2) allow the door to open a limited distance, or (3) allow the door to open freely. The lock has a door-mounted latch assembly that includes a base plate, an intermediate link pivoted to the base plate, and a mode selection and latching assembly that is pivoted to the intermediate link. The latch assembly has a high strength latch member and a camming system to slide the latch member back and forth as a control knob is rotated.

A latch plate is mounted on the door frame in juxtaposition to the door-mounted latch assembly. The latch plate has a cylindrical or tubular portion with an opening for receiving the latch member. An optional sleeve fits inside the cylindrical or tubular portion of the latch plate. The sleeve has an opening for receiving the latch member. When the latch member is engaged in the tubular portion of the latch plate, the sleeve may be rotated so that the latch member is engaged in the sleeve. The latch member then cannot be directly withdrawn from the latch plate.

The embodiments disclosed in my aforesaid U.S. Pat. No. 5,244,240 are provided with means for locking and unlocking a door from the interior side of the door only. However, in every day use, it is desirable to be able to lock and unlock the lock from the exterior side of the door, such as when leaving for work in the morning or returning home in the evening.

It is also desirable to provide a system for locking the sleeve into place once it has engaged the latch member in a secured position. Such a feature decreases the likelihood that the user would disengage the sleeve from the latch member. Furthermore, such a feature provides added protection against an intruder attempting to force the door open from the exterior.

Moreover, while the alarm industry is huge, fast growing, and technically very sophisticated, the focus and concentration is on generating an alarm once the perimeter security has been breached; and no one, prior to my invention, has combined existing off-the-shelf alarm hardware and monitoring methods with a vastly improved lock that provides excellent perimeter security to prevent a breach in the first instance.

BRIEF SUMMARY OF THE INVENTION

Accordingly, it is a primary object of the present invention to combine existing off-the-shelf alarm hardware and monitoring methods with a vastly improved lock that provides excellent perimeter security to prevent a breach in the first instance, thereby providing the maximum degree of mechanical and electrical protection.

My invention is fully compatible with state-of-the-art technology involving both wired and wireless alarm systems and can be retrofitted to existing structures, as well as being installed initially in new construction.

In combination with such alarm systems, it is desirable to provide a Z-Bar lock such as that disclosed in my aforesaid U.S. Pat. No. 5,244,240 with a latch system that will pivotally secure the latch member in place when it is engaged in the latch plate. It is also desirable to provide a system for locking and unlocking such a lock from the exterior side of the door. These goals are satisfied by the various embodiments of the present invention.

One system for pivotally securing a latch member to a latch plate that is mounted on a door frame has a latch plate that has a tube. The tube has an opening for receiving the latch member. There is a rotatable sleeve positioned inside of the tube. The sleeve has an opening for receiving the latch member. A handle is affixed to one end of the sleeve for rotating the sleeve to engage the latch member inside the sleeve opening in a secured position. The latch plate also has a locking system that may releasably lock the sleeve into the secured position. The system has a locking detent, a locking member and a spring. When the sleeve is in the secure position, the spring holds the detent into engagement with the locking member. The sleeve is then prevented from rotating relative to the tube. The spring may be depressed to disengage the detent from engagement with the locking member.

In accordance with other aspects of the present invention, and in combination with suitable alarm systems, the locking system may utilize a locking pin. For instance, the rotatable sleeve and the latch plate tube may both include a locking pin aperture. The two apertures come into alignment in the secured position. The locking pin, which is spring-loaded, is mounted within the sleeve. The locking pin may have a head which protrudes through both of the locking pin apertures when the sleeve is in the secured position. The sleeve is thereby prevented from moving relative to the latch plate tube.

As another alternative, a system for pivotally securing the latch member to the latch plate may be a protrusion and slot system. The latch plate tube may have a slot which has at least one engagement portion. The latch plate may have a spring mounted within the tube such that the spring is substantially juxtaposed to the rotatable sleeve. The sleeve itself has a protrusion which is in engagement with a slot. In the secured position, the spring will tend to position the protrusion into the engagement portion of the slot, thereby preventing the sleeve from rotating relative to the tube. Alternatively, a similar system may include a sleeve which has a slot with an engagement portion. The protrusion may then be located on the tube.

A Z-Bar door security system providing (1) entry, (2) inspection, and (3) dead-bolt modes of operation, which can be locked and unlocked from the exterior side of the door, has a latch plate for mounting on the frame of a door. The latch plate has an opening for receiving a latch member. The system also includes a Z-Bar latch assembly for mounting on the interior side of the door. The Z-Bar assembly includes a base plate which can be secured to an edge of the interior side of the door. The assembly also includes an intermediate link which is pivotally connected to the base plate. The assembly also includes a mode selection and latching assembly which is pivotally mounted to the intermediate link. The mode selection and latching assembly includes an extendable high strength latch member. A camming mechanism to linearly advance the latch member into engagement with the opening in the latch plate is part of the mode selection and latching assembly. The system also has a securing member which secures the base plate, the intermediate link and the mode selection and latching assembly together in a secured position while the latch is extended into engagement with the latch plate in the dead bolt mode of operation. The system further include a latch assembly control mechanism to selectively lock and unlock the latch assembly from the exterior side of the door.

In accordance with another aspect of the present invention, the latch assembly control system has a key-operated cylinder for mounting on an exterior of a door. A shaft is connected at one end to the key operated cylinder and has an adapter connected to the other end of the shaft. The adapter rotationally engages with the securing member. The latch assembly control system additionally has a mounting plate which is mounted on the interior side of the door in between the door and the base plate.

Viewed in another aspect, the present invention provides a perimeter security system, wherein the system includes at least one door received within a door jamb. A lock assembly is mounted on the inside of the door and has a three-position rotating cylinder operable by a key from outside of the door. The cylinder has three positions corresponding to "open", "viewing" and "closed" positions of the door, respectively. In the "viewing" position of the door, the door may be opened partially, such that a visitor may be properly identified while providing good security against an intruder. A laterally-movable latch member is operated by the rotating cylinder, and a latch assembly is mounted on the door jamb for receiving the latch member. The latch assembly includes manually-selectable means for preventing the door from being opened. An alarm system is further provided, including at least a first sensor for detecting when the door has been forced open by an intruder. The alarm system further includes a transmitter responsive to the first sensor for generating an alarm signal, and a remote receiver receives the alarm signal from the transmitter.

In a preferred embodiment, the lock assembly comprises a Z-bar latch assembly. Preferably, the Z-Bar latch assembly has a pivotable plate operable in the "viewing" position of the door to enable the door to be opened partially.

In the preferred embodiment, the first sensor (for detecting when the door has been forced open by an intruder) comprises a door opening sensor which uses a two-part magnetic contact device, one on the door and the other on the door jamb.

The perimeter security system of the present invention further includes a second sensor for detecting tampering of the lock assembly and a third sensor comprising a motion detecting sensor to detect movement within a certain distance of the door externally thereof.

In a further embodiment, the door has a window; and a fourth sensor detects breakage of the window.

These and other objects of the present invention will become apparent from a reading of the following specification taken in conjunction with the enclosed drawings.

DESCRIPTION

Figure 1:
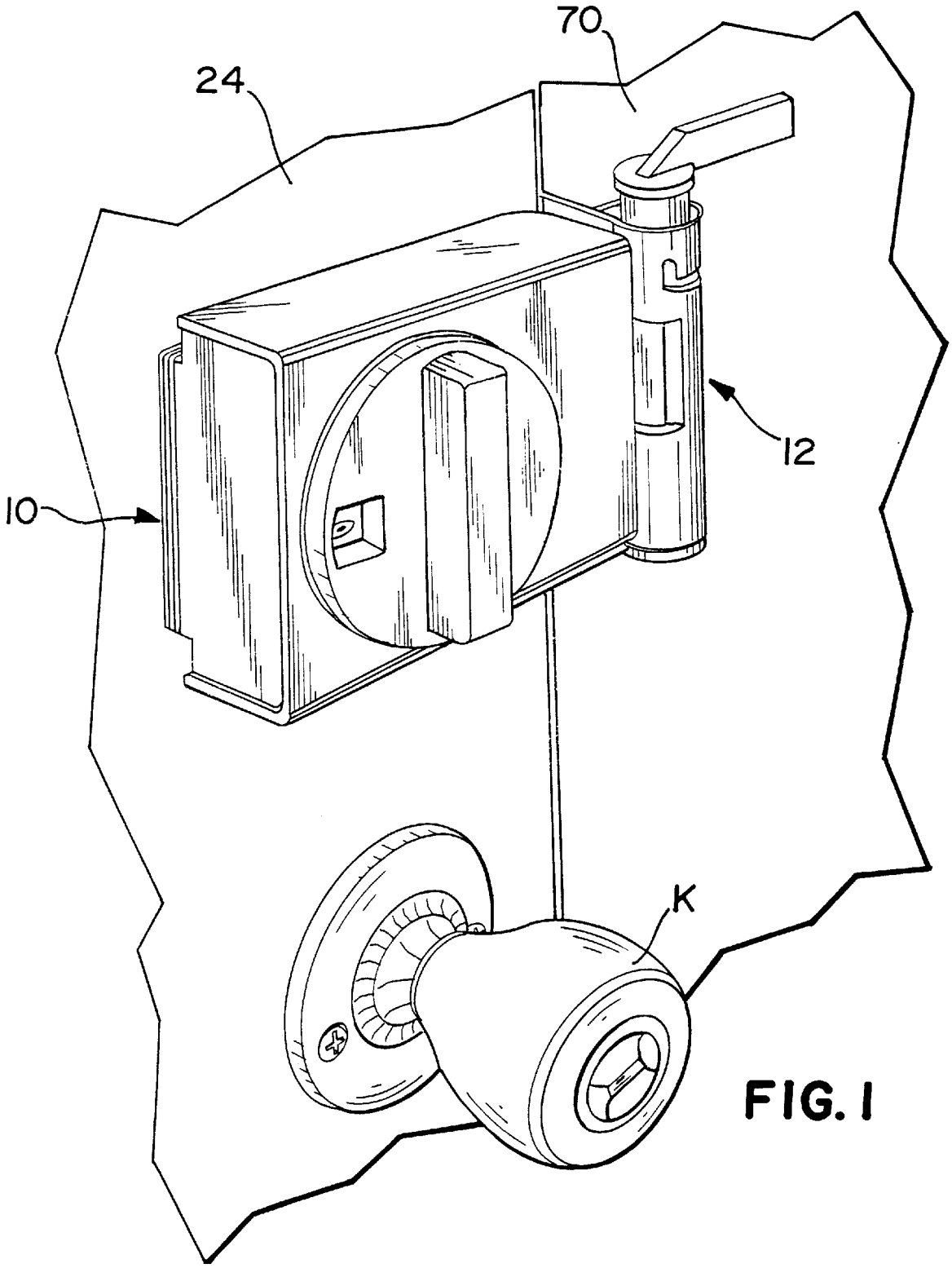
FIG. 1 is a perspective view of the Z-Bar latch assembly attached to the interior of a door and connected to a latch plate mounted on a door jamb.

Referring to FIGS. 1–4, the Z-Bar door security system of the present invention operates in five (5) modes. In the free-opening mode, the door is freely opened without any interference from the system. In the inspection mode, the door is permitted to open only a limited distance so that the person inside of the door can view and talk with the person outside of the door while preventing the person outside of the door from having access. Three (3) dead bolt modes are provided. The door may be locked in a dead bolt fashion from inside of the door. The door may be locked in a dead bolt fashion from outside of the door, using a key. The door may be locked in a dead bolt fashion from inside of the door such that a person outside of the door with a key cannot gain access.

The Z-Bar door security system is composed of four (4) major components: a latch assembly 10, a latch plate assembly 12, an adapter plate 14 and a key cylinder assembly 16.

Figure 5:
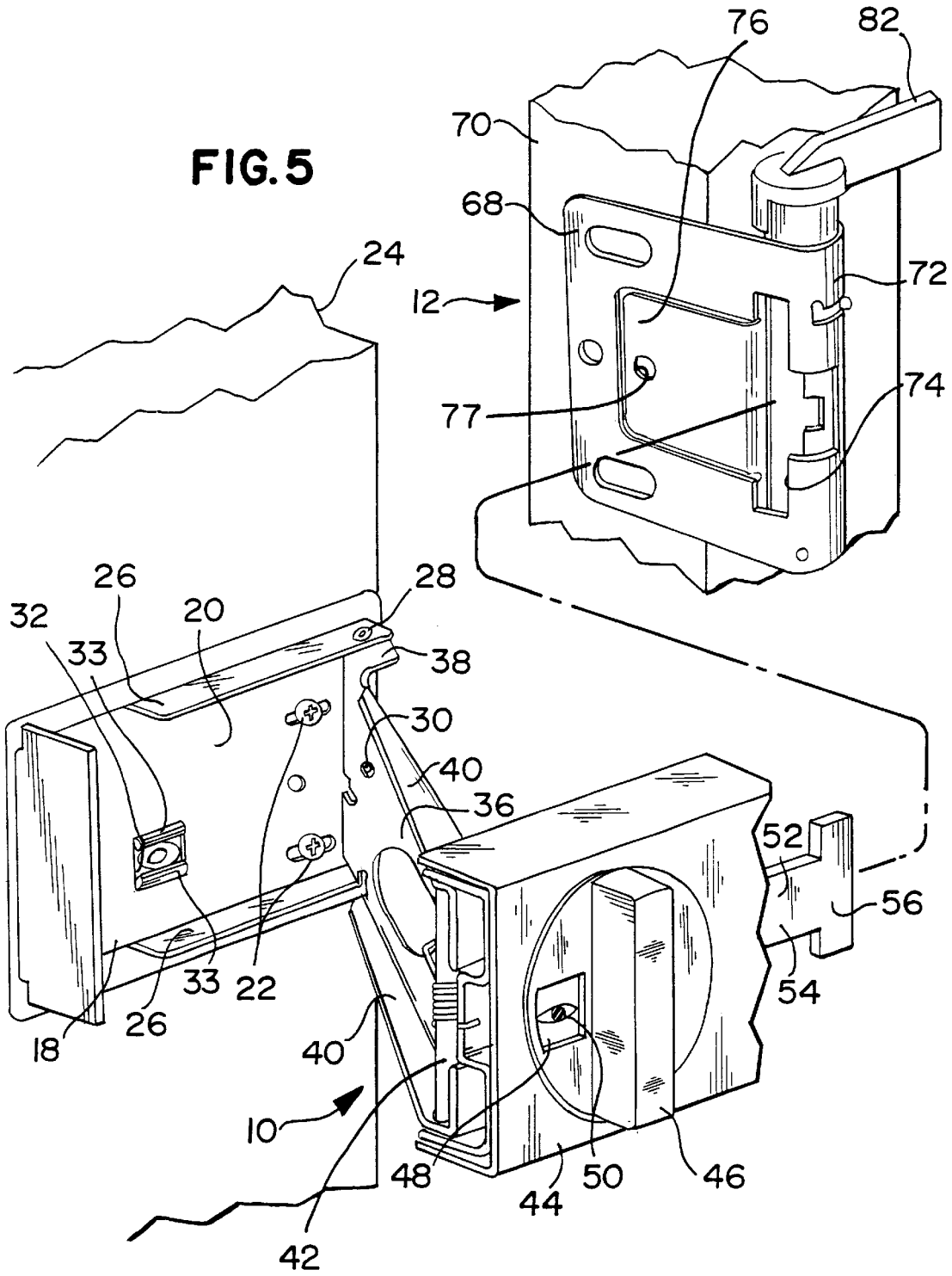
FIG. 5 is a perspective view of a door and a doorjamb showing the present invention mounted thereon.
Figure 6:
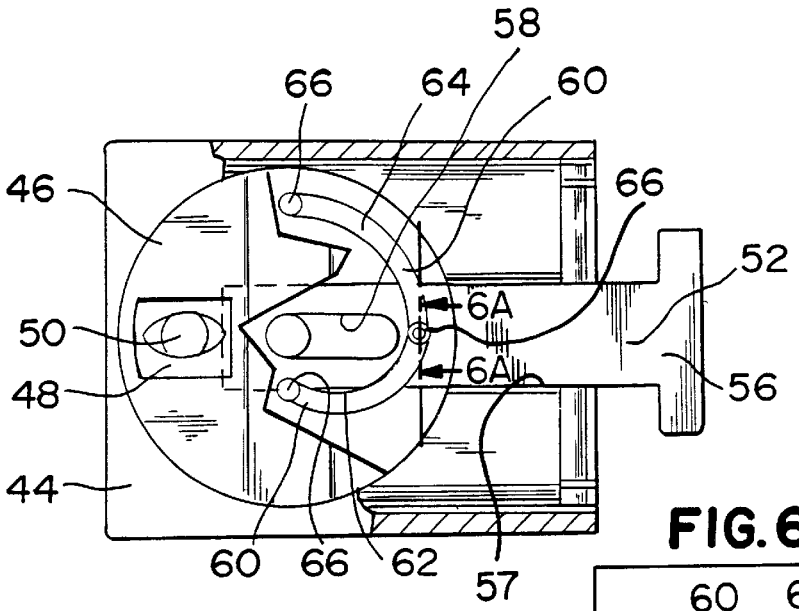
FIG. 6 is a partially cut away plan view of the inside of the mode selection assembly.
Figure 6A:
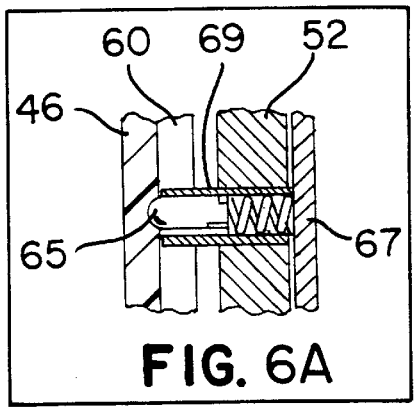
FIG. 6A is a cross-sectional view taken across the lines 6A—6A of FIG. 6.
Figure 12:
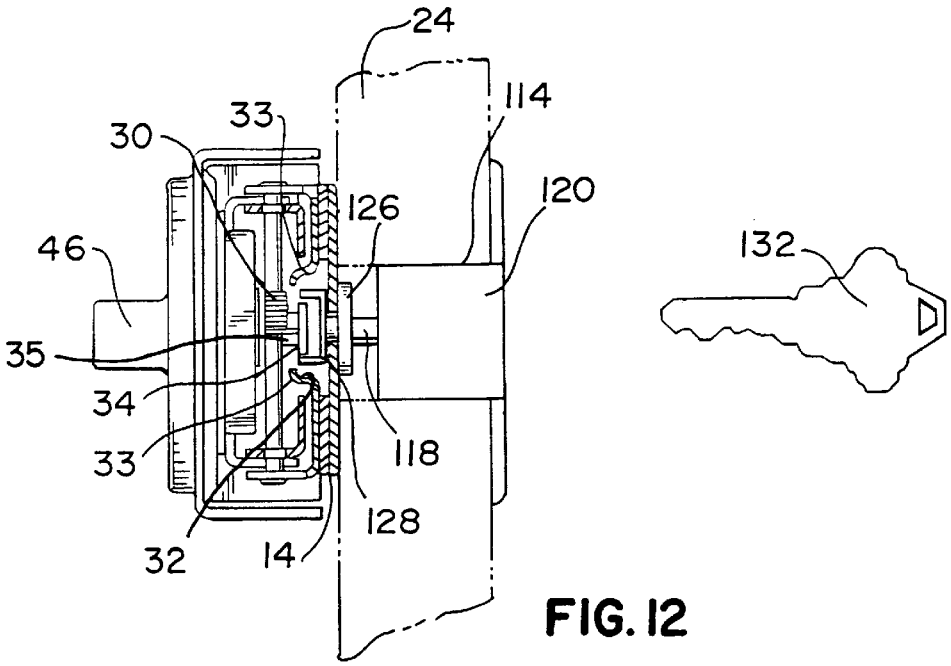
FIG. 12 shows the components of FIG. 11 mounted on a door, with the Z-Bar lock being mounted on the interior of the door.

As shown in FIG. 5 the latch assembly 10 has a base plate 18. The base plate 18 comprises a base 20 which has suitable screw holes with screws 22 mounted therein for secure attachment of base 20 onto the interior of the door 24. Base plate 18 has upturned flange edges 26. The flange edges 26 have a pivot pin hole at the end of the base toward the door edge, and pivot pin 28 extends through this hole. A bias spring 30 is coiled around pivot pin 28 and bears at one end onto the intermediate link 36. The base plate 18 further comprises an aperture 32, through which a locking flange 34 (FIG. 12) can pass. The aperture 32 has a pair of opposing retention flanges 33 formed at the top and the bottom respectively of the aperture 32.

The intermediate link 36 is connected to the base plate 18. The intermediate link 36 has, at one end, a pair of flanges 38 through which first pivot pin 28 passes. The intermediate link 36 also has down turned, tapered flange edges 40. The narrow end of tapered flanges 40 begins near the base plate 18 and increases in width along the length of intermediate link 36. The wide end of each of the flanges includes an aperture through which passes a second pivot pin 42.

The mode selection assembly 44 has a control knob 46, which includes a mode indicator including a view window 48 and symbols 50. Rotation of the control knob 46 rotates a central post 35 at the end of which is the locking flange 34. The locking flange 34 engages or disengages the retention flanges 33 depending upon the rotation of the control knob 46. In the inspection mode, the locking flange 34 is disengaged from the retention flanges 33 permitting the Z-Bar system to be extended.

The mode selection and latching assembly 44 also has a T-shaped latch bar 52, comprised of a long neck portion 54 and a relatively narrower crossbar 56 at the outer end thereof Latch bar 56 is positioned in a channel 57, along which the latch bar can slide. An opening or slot 58 in the long neck portion 54 of latch bar 52 allows the central post 35 to pass through.

A portion of the control knob 46 acts as a camming means which drives the latch bar 52 along the channel. The control knob 46 has a groove 60 consisting of groove segments 62 and 64. Groove 60 overlies a detent assembly consisting of a pin 65, a spring 67 and a sleeve 69. The sleeve 69 passes through the latch bar 52. The bottom portion of the spring rests along the top of the channel. The pin 65 is situated inside of the sleeve 69 and is biased into the groove 60 by the spring 67. As the control knob 46 rotates, the pin travels along the groove 60. When the pin travels along the first groove segment 62, the contour of the first groove pushes the latch bar 52 either forward or backward, depending on the direction of rotation of the control knob 46. When the pin travels along the second groove segment 64, the contour of the groove does not affect the position of latch bar 52, and permits rotation of the control knob 46 and locking flange 34 without shifting the position of the latch. The groove 60 has indentations 66 that serve as stopping points or detents for the pin. The location of each indentation 66 corresponds to the proper control knob position for the free-opening, inspection, and dead bolt modes of operation. When the pin reaches a groove indentation 66, the spring forces the pin into the indentation. The user must apply additional rotational force to dislodge the pin from the indentation 66 in which it is located.

The latch plate assembly 12 has a base 68 which has suitable screw holes in which screws are mounted for secure attachment of the base 68 onto a doorjamb 70. The latch base 68 is formed into a substantially tubular configuration 72 at one edge. The base 68 has a T-shaped aperture 74 such that the crossbar of the "T" extends vertically between the top and the bottom of the tubular portion 72 and the stem portion of the "T" follows a path around the tubular portion 72. A tongue 76 is formed in the plate base 68 adjoining the T-shaped aperture. At least one suitable screw hole 77 is formed in the tongue 76 in which a screw is mounted for secure attachment of the latch plate assembly 12 to doorjamb 70. A latch-securing sleeve 78, also known as a rotating cylinder or tube, is inserted into latch plate tube 72 for the purpose of securing the latch within the tube in a secured position. The latch 52 enters the latch plate base 68, at the T-shaped aperture 74, then passes through the aperture 79 of the sleeve 78. The user turns the handle 82, thereby rotating the sleeve 78, and securing the crossbar 56 of the latch bar 52 behind the portions of the rotated sleeve 78. In this manner, the crossbar 56 is held within the latch plate tube 72, and cannot be pried out of latch plate assembly 12 until the user turns the handle 82 back to its original position. A locking system, as described below, is provided for releasably locking the sleeve 78 into the secured position. The locking system thereby prevents the user from accidentally disengaging the system from the secured position, and serves to make it more difficult for an intruder to disengage the lock from the outside.

Figure 7:
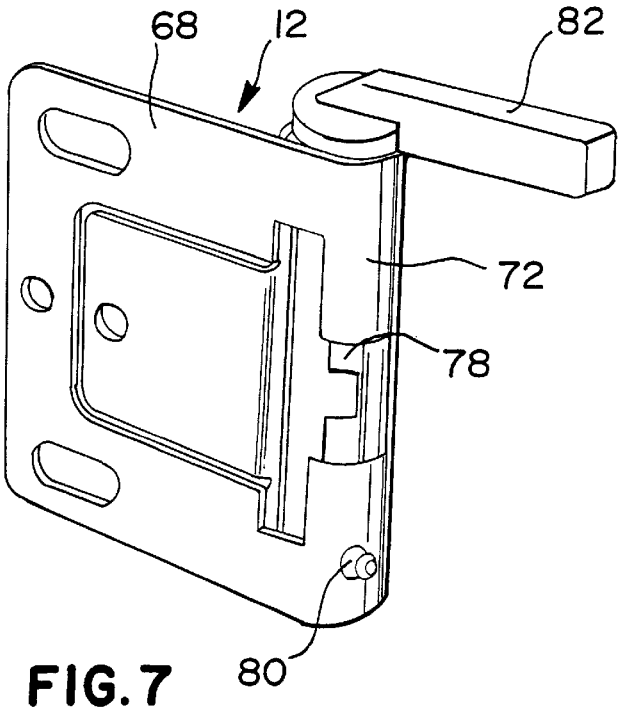
FIG. 7 is a perspective view of a latch plate having a spring-biased button sleeve locking system.
Figure 8:
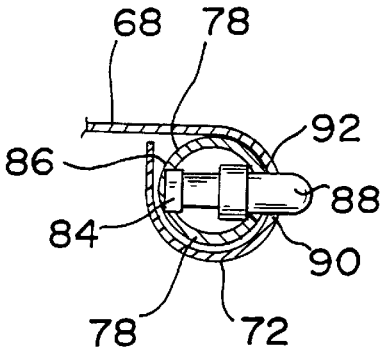
FIG. 8 is a sectional view showing the spring-biased bottom of FIG. 7 mounted within the sleeve.

FIG. 7 illustrates a latch system locked into a secured position by means of a locking pin 80. To disengage the system from the secured position, a user pushes in the locking pin 80 and turns the handle 82. FIG. 8 shows more particularly how the locking pin 80 is mounted within sleeve 78. The locking pin 80 has a locking pin base 84 which mounts at one end into a locking pin base mounting aperture 86 provided in the sleeve 78. The locking pin 80 also has a retractable locking pin head 88. The latch plate tube 72 and the sleeve 78 both include locking pin head apertures 90, 92.

When the sleeve is rotated into the secured position, the locking pin head apertures 90, 92 are aligned. An internal spring then pushes the locking pin head 88 through both apertures until the pin protrudes through both apertures and prevents the sleeve 78 from rotating. The protruding pin head thereby locks the system into the secured position shown in FIG. 7. To unlock the system, the user pushes the locking pin head 88 back through the latch plate tubular aperture 90 and simultaneously rotates handle 82.

Figure 9:
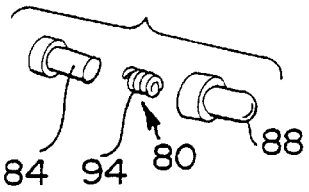
FIG. 9 is an exploded view of the spring-biased button.

FIG. 9 shows that a spring pin base 84, an internal spring 94, and a locking pin head 88 are the component parts of the locking pin 80. The spring 94 fits inside of the spring pin base 84, with a portion of the spring protruding out of the base. Locking pin head 88 fits over a portion of the spring pin base 84, with the remaining protruding portion of the spring fitting into the interior of the locking pin head. The locking pin head 88 is thereby spring biased in a direction away from the locking pin base 84.

Figure 10:
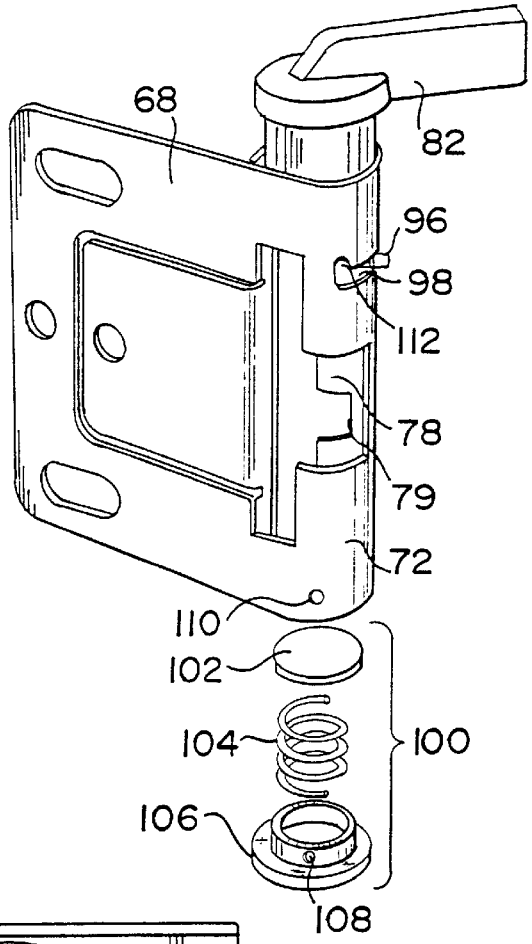
FIG. 10 is a perspective and exploded view of a latch plate having a slot and protrusion-type sleeve locking system.
Figure 13:
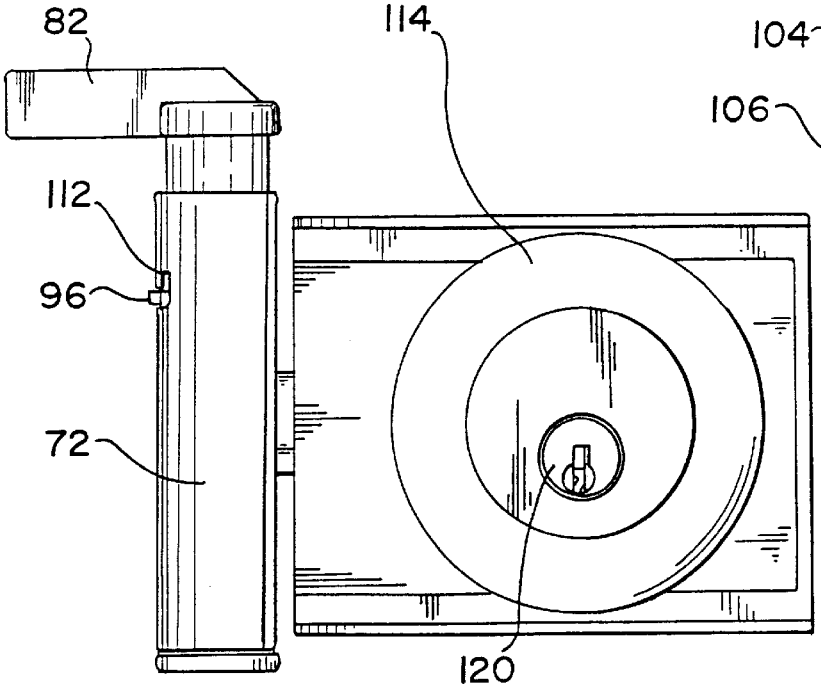
FIG. 13 is a plan view, with the door not shown, of a Z-Bar security system in the dead bolt mode with the latch member locked within the sleeve having the sleeve locking system of FIG. 10 with two angular portions.
Figure 11:
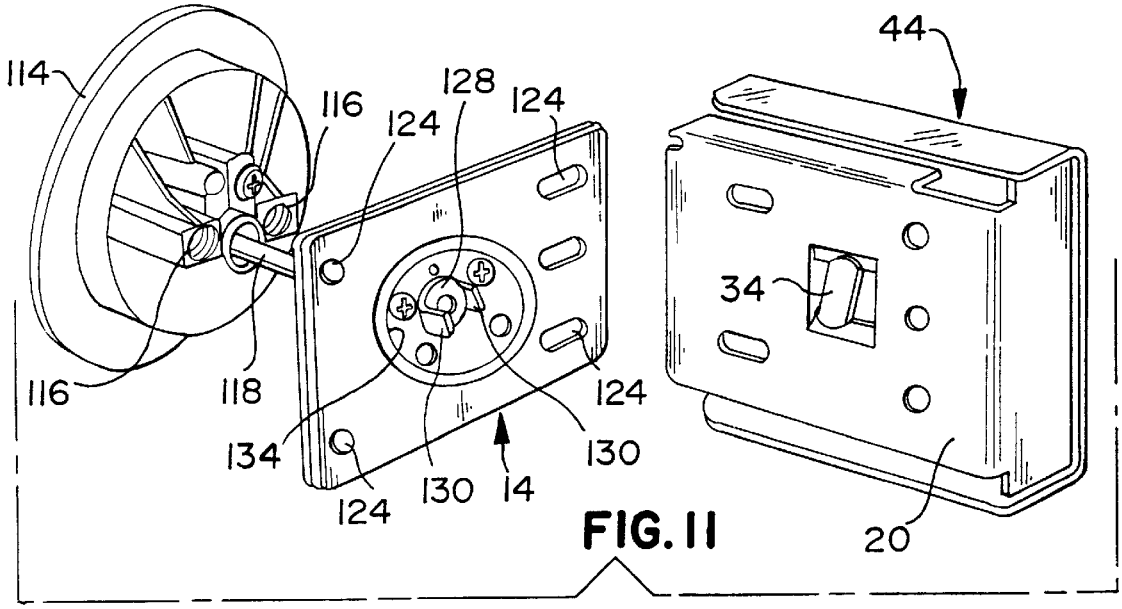
FIG. 11 is an exploded view of a Z-Bar lock with a key-operated cylinder system for unlocking the Z-Bar lock from the exterior side of a door.

FIGS. 1 and 10 illustrate yet another one of the many possible alternative embodiments of a latch securing system. This embodiment includes a protrusion 96 and L-shaped slot system for maintaining the sleeve in the secure position. A protrusion 96, which may also be called a pin, is provided on the inner latch securing sleeve 78. The protrusion 96 may be a simple solid metal tube that is spot welded onto the inner sleeve 78. A slot 98 extends entirely through the tube 72, and the protrusion 96 is engaged in the slot 98. The sleeve 78, is spring biased upwardly by spring biasing unit 100. The biasing system includes a sleeve cap 102 which is welded to the bottom end of sleeve 78. The system also includes a coil spring 104 mounted within tube 72. Spring 104 is welded or otherwise attached at one end to sleeve cap 102 and is welded or otherwise attached at the other end to an end cap 106, which press fits into the interior of the end of latch plate tube 72. The end cap 106 may have a nub 108 which engages with a matching aperture 110 on the bottom of latch plate tube 72, for holding the end cap in place and for preventing it from disengaging from latch plate tube 72.

The spring biasing has the following effect. The L-shaped slot 98 has a linear portion and an angular portion 112, the angular portion 112 corresponding to the base of the "L", which preferably is at an angle of 90° with respect to the linear portion of the slot 98. When the user rotates the handle 82 into the secured position, the protrusion 96 comes into alignment with the angular or engagement portion 112 of the L-shaped slot 98. It should be noted that the "L" referred to preferably is oriented sideways with the long portion of the "L" running in a horizontal direction and the short base portion of the "L" being an upturned, vertical portion.

When the protrusion 96 comes into alignment with the angular portion 112 of the slot 98, the biasing spring unit 100 pushes the sleeve 78, upwardly, positioning the protrusion 96 inside the angular portion 112 of the slot 98. The handle 82 and sleeve 78, are thereby prevented from turning in either direction. To disengage the handle 82 out of the secured position, the handle 82 must be pushed down to move the protrusion 96 to the bottom of the angular portion 112 of slot 98 and into the linear portion of the slot 98. The handle 82 may then be rotated out of the secured position.

FIG. 1 shows a protrusion and slot securing system of FIG. 10 mounted on a door jamb 70 with the latch bar 52 secured within the latch plate tube 72. Protrusion 96 is engaged in the upturned portion of the slot 98, thereby preventing handle 82 from turning and preventing the latch member from disengaging from latch plate assembly 12.

As an alternative embodiment, the protrusion 96 may be provided on the tube 72, and the slot 98 may be provided on the sleeve 78. It should be noted that the slot 98 need not be L-shaped but may have a different shape with an engagement portion (or portions).

Figure 3:
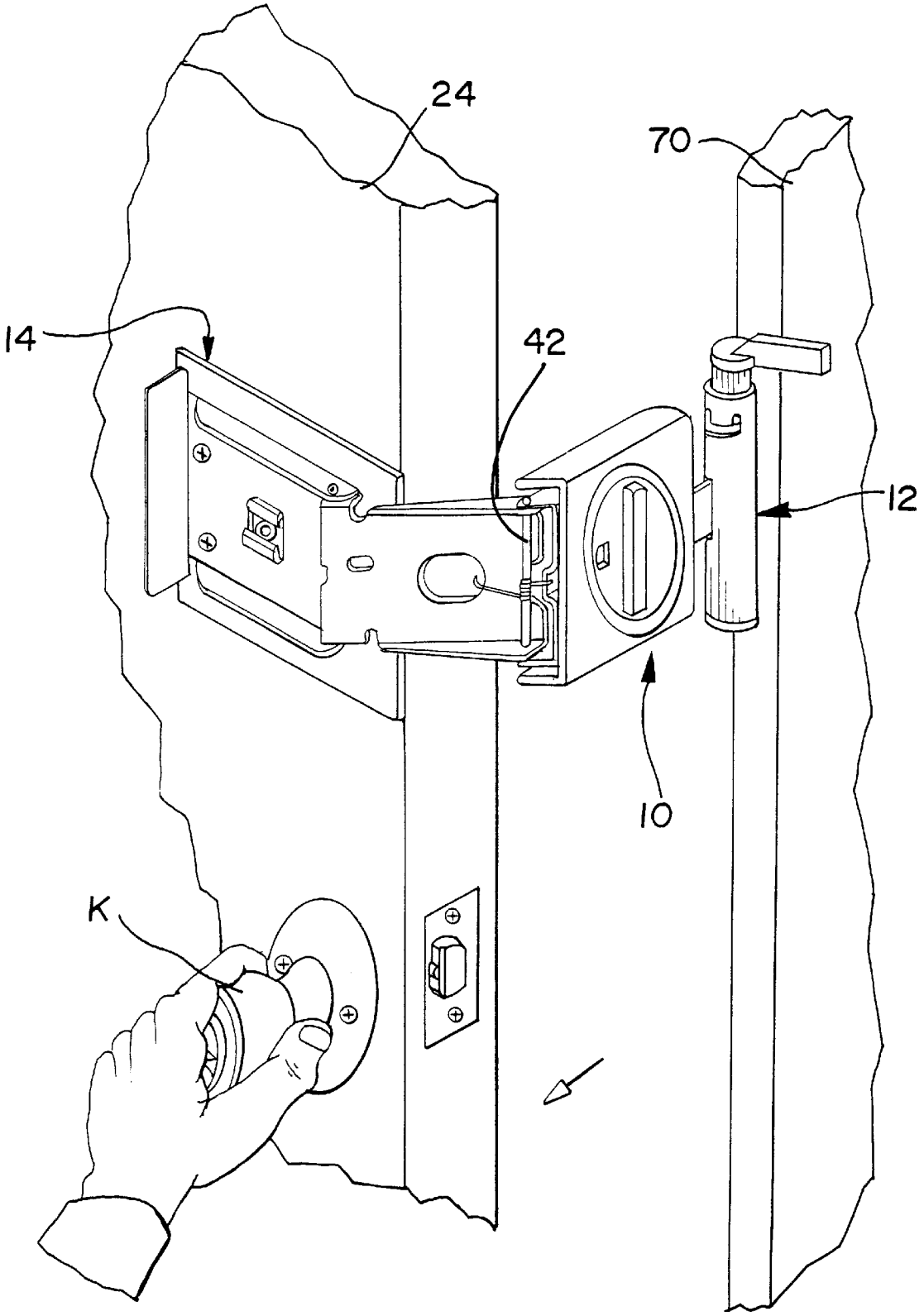
FIG. 3 is a perspective view of the Z-Bar latch assembly in the inspection position limiting the opening of the door.
Figure 4:
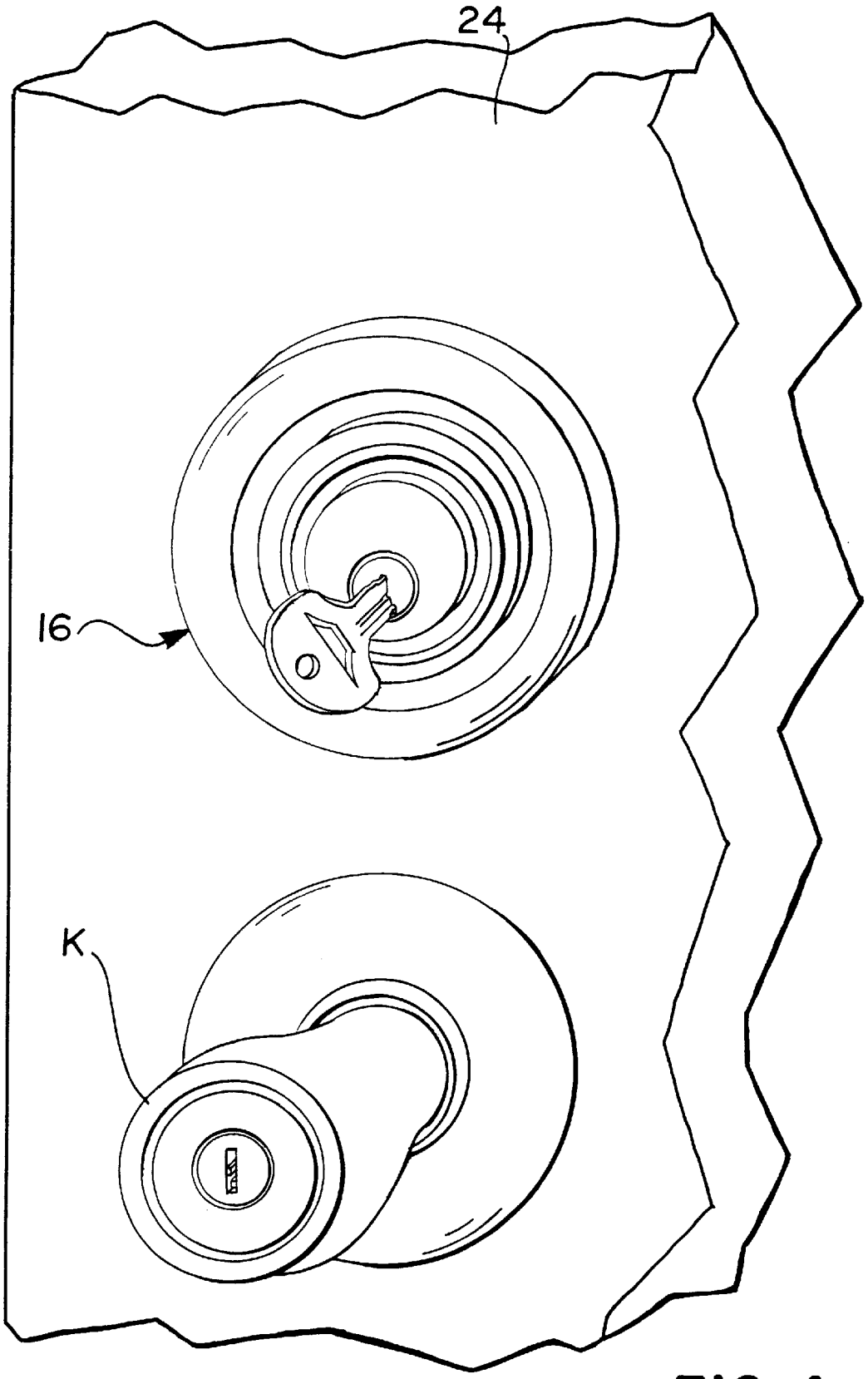
FIG. 4 is a perspective view of the exterior of the door showing the key inserted in the cylinder of the Z-Bar door latch system.

An example of slot with two engagement portions is shown in FIG. 3. The slot 98 is substantially U-shaped with two angular (or engagement) portions, 112, each angular portion 112 being at the opposite ends of the linear portion of the slot 98. It is preferred that the slot 98 be formed near the upper end of the tubular portion 72 of the latch plate assembly 12 with the angular portions 112 being oriented toward the handle 82. This U-shaped slot has the benefit of providing two secured positions for the sleeve 78. One secured position operates in a manner similar to the L-shaped slot described above and prevents movement of the sleeve 78 so that latch is in the locked dead bolt mode and the door cannot be opened with or without a key. The other secured position operates to keep the sleeve 78 in an open position so that the latch bar 52 can be disposed in, or removed from, the latch plate assembly 12 as determined by the positioning of the mode selector assembly 44 and the desires of the user. In the other secured position, the user is assured that the sleeve 78 will not inadvertently move or be moved from the unlocked position.

The present invention also includes means for locking and unlocking the lock from outside the door while the door is closed. This is desirable where the user wishes to lock the security system into the dead bolt mode to secure his/her home when he/she leaves, then unlock it when he/she returns. Alternatively, this allows someone such as a spouse to lock the door in the dead bolt or inspection mode while the spouse is in the house, while permitting the other spouse to unlock the door from the outside when he/she comes home.

One such exterior locking means is illustrated in FIGS. 4, 11–13 and includes a key-operated cylinder assembly 16 mounted on the exterior of the door 24. The key-operated cylinder assembly includes a key-operated cylinder housing 114 with threaded screw shafts 116 for mounting onto a door. Key-operated cylinders are well known in the art and are readily available for purchase from a wide variety of lock manufacturers.

An adapter plate 14 is mounted onto the interior side of the door 24. The adapter plate 14 may be mounted onto the door with screws at mounting apertures 124. The base 20 of the latch assembly 10 is mounted onto the door 24 by means of screws or nails which pass through mounting apertures in the base 20 and mounting apertures 124 in the adapter plate 14. The base 20 of the latch assembly 10 is thus juxtaposed against the adapter plate 14. A door indentation 126 may be cut into the door to accommodate an adapter 128, which is juxtaposed to the exterior side of the adapter plate 14. The adapter 128 is connected to the adapter plate 14 so that the adapter 128 is freely rotatable within the adapter plate 14. The adapter 128 has an opening formed therein to receive one end of the rotary shaft 118 and to hold the shaft 118 position. The rotary shaft 118 passes through a bore extending between the exterior side and the interior side of the door 24 and has an opposite end connected to the key-operated cylinder 120. The adapter 128 includes prongs 130 which engage with the locking flange 34 (which is also known as the locking member). The prongs 130 rotate the locking member 34 as the user turns the key 132 after insertion into the key-operated cylinder 120 through the key hole.

When the door 24 is closed, rotating the key operated cylinder 120 tends to latch or unlatch the latching member (the latch bar 52) from the latch plate assembly 12. For instance, when the lock is in the dead bolt mode, rotating the key-operated cylinder 120 in a counter clockwise direction (as viewed by a viewer facing the front of the door 24) will cause locking flange 34 and control knob 46 to rotate to the view mode and ultimately to the free-open mode. Likewise, when the lock is in the free-open mode, rotating the key-operated cylinder 120 in a clockwise direction will cause locking flange 34 and control knob 46 to rotate to the view mode and ultimately to the dead bolt mode.

The Z-Bar door security system operates in five modes. In the free-opening mode, the door is freely opened and shut without any interference from the system. In the inspection mode, the door can open only a limited distance. In the three dead bolt modes, the system prevents the door from opening at all. The following is a detailed description of how the system operates in each mode.

In the free-opening mode, the control knob 46 has been rotated into the free-swing position, thereby rotating locking flange 34 into the engaged position with retention flanges 33. Rotation of the control knob 46 has also put the latch bar 52 in the retracted position, disengaged from the latch plate assembly 12, so that the security system does not prevent the door from swinging open freely when the door knob K is rotated to open the door 24.

To position the security system in the inspection mode from the free-swing mode, the user rotates the control knob 46 to disengage locking flange 34 from the retention flanges 33 on the base plate 18 of the latch assembly 10. Simultaneously, latch bar 52 extends to engage with latch plate assembly 12 through T-shaped aperture 74, by operation of the cam action of the control knob 46.

Figure 2:
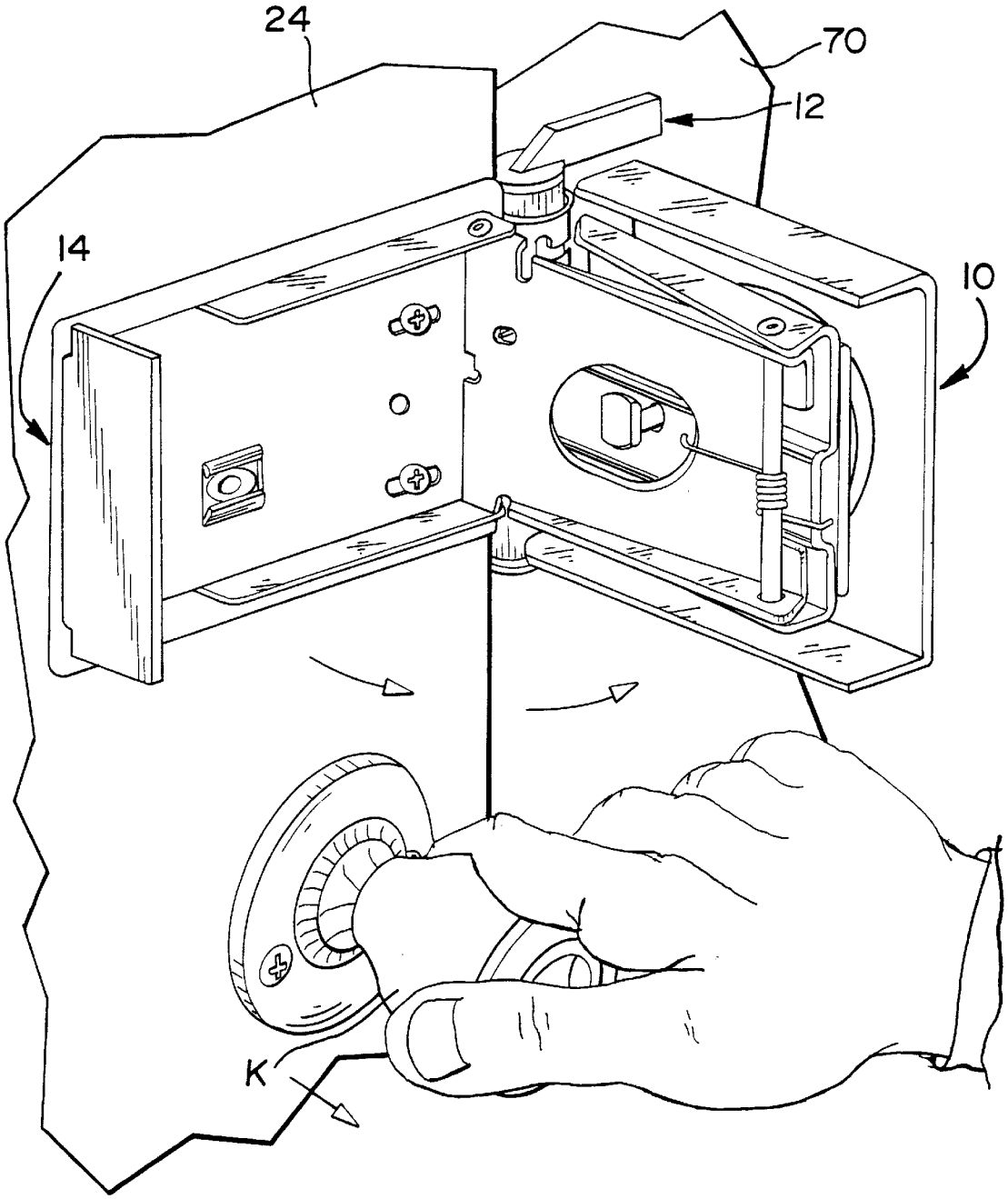
FIG. 2 is a perspective view of the door being partially opened and the latching assembly unfolding from the closed position to the inspection position.

As the door 24 swings open, the base plate 18 and intermediate link 36 unfold from the latched position to the extended position (FIGS. 1–3). Once the base plate 18 and the intermediate link 36 have fully extended, the door 24 cannot swing open any further. The laterally extending portions of the crossbar 56 of the latch are held within the tube 72 of the latch plate assembly 12.

To put the security system into any one of the dead bolt modes from the inspection mode, the user shuts the door so that bias spring 30 causes the intermediate link 36 and the mode selection and latching assembly 44 to fold together over base plate 18 of the latch assembly 12. The user then rotates control knob 46 to the dead bolt position, such that the locking flange 34 is positioned perpendicular to the length of the base plate aperture 32 and in engagement with retention flanges 33. The shape of groove 60 is such that latch bar 52 does not retract as the user rotates control knob 46 from the inspection mode position to the dead bolt mode position. With the Z-Bar latch assembly folded and locked together, and with latch bar 52 engaged with latch plate assembly 12, the security system acts as a dead bolt, preventing the door from opening.

In the first dead bolt mode, the handle 82 on the latch plate assembly 12 is rotated to move the inner, latch securing sleeve 78, free of the latch bar 52. In the embodiment with the U-shaped slot, the handle 82 is secured in the free position. The mode selection assembly 44 is set in the locked position. In this mode, the door 24 can be opened by rotation of the control knob 46 from within the door 24.

In the second dead bolt mode, the handle 82 is in the same disposition as in the first dead bolt mode and the mode selection assembly 44 is set in the locked position. In this mode, a person with a key 132 can lock or unlock the door 24 in a dead bolt position by turning the key 132 from outside of the door.

In the third dead bolt mode, the handle 82 is rotated so that the inner, latch securing sleeve 78, is disposed over the crossbar 56 portion of the latch bar 52. This prevents the latch bar 52 from being removed from the T-shaped aperture 74 in the tubular portion 72 of the latch plate base 68. The embodiment with either the L-shaped or the U-shaped slot biases the securing sleeve 78 in the closed position and the handle 82 is locked in position. In this mode, the latch system cannot be opened by a person outside of the door even with a key. The only way to open the latch system from inside of the door is to rotate the handle 82 to the free position and then to rotate the control knob 46 to the unlocked or to the inspection mode.

The door cannot be opened in this mode even if an intruder were to forceably remove the key and cylinder 120. This is because, unlike a standard lock, the cylinder is not directly connected with a bolt which extends into the door-jamb 70. In the present invention, the rotary shaft 118 from the locking cylinder 120 engages the adapter 128 which is disposed in the adapter plate 14. The adapter 128 turns the locking flange 34 (securing member) to be disengaged from the retention flanges 33 on the base of the mode selection assembly 44. This permits the latch bar 52 to engage and disengage the latch plate assembly 12. However, when the latch bar 52 is secured in the latch plate assembly 12 by rotation of the handle 82, the latch bar 52 cannot be disengaged except from the interior of the door 24.

Concerning dimensions, it is desirable that the bolt or latch member be of considerable strength, and it is preferably made of steel, at least ⅛ inch thick, and preferably 3/16 inch thick. It is approximately 1¼ inch wide at the end, about ⅝ inch wide along its length, and about three inches long. These dimensions are given by way of example and not of limitation.

With the rotation cylinder actuated in the latch plate assembly to the locked position, the security is equal to and probably greater than that provided by conventional dead bolts, as the bolt or latch member of the present invention cannot be directly withdrawn from the latch plate.

Figure 14:
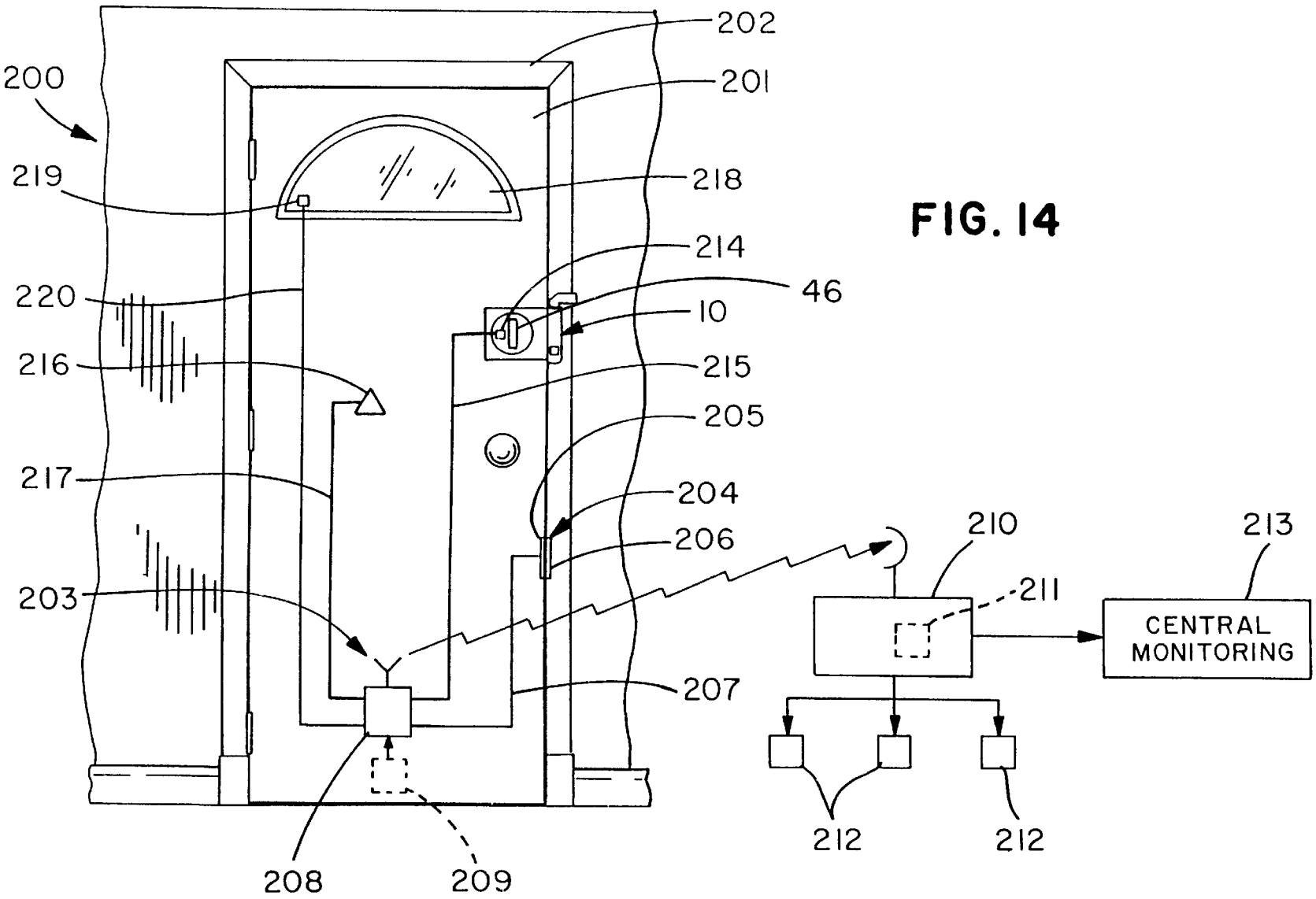
FIG. 14 is a schematic block diagram of a preferred embodiment of the present invention, showing the combination of the three-position Z-Bar lock equipped with an alarm system.

With respect to FIG. 14, the perimeter security system 200 of the present invention includes at least one door 201 within a door jamb 202.

It will be appreciated by those skilled in the art that in any given building structure, each of the doors (and, ultimately, each of the windows or other openings) in the structure may be equipped with the substantially improved mechanical and electronic protection of the present invention, thereby providing a total perimeter security system.

With this in mind, the door 201 is equipped with the preferred Z-Bar lock assembly 10 shown in FIGS. 1–13 and described herein.

Cooperating with the Z-Bar lock assembly 10 is an alarm system 203, thereby providing the maximum degree of mechanical and electronic security.

The alarm system 203 includes a first sensor 204 for detecting when the door 201 has been opened. This first sensor 204 uses a two-part magnetic contact device 205 and 206 mounted on the door 201 and the door jamb 202, respectively. The first sensor 204 is mounted on the inside of the door 201 and is hard wired, as at 207, to a transmitter 208. The transmitter 208, which is also mounted on the inside of the door 201, includes a slide-out battery pack 209 which may be rechargeable.

Upon detecting a signal from the first sensor 204, the transmitter generates an RF (or other) signal which is received by a remote receiver 210 powered by a battery pack 211 (which, preferably, is rechargeable). The receiver 210, in turn, triggers one or more alarms 212 which may be aural or visual (or both). The receiver 210 may also trigger a remote control station 213 for monitoring of the alarm system 203.

A second sensor 214 is directly associated with the improved Z-Bar lock 10 and detects any tampering of the improved Z-Bar lock 10. This second sensor 214 is hard wired, as at 215, to the transmitter 208.

A third sensor 216 is a motion-detecting sensor and senses any movement within a certain distance of the door 201 externally thereof This third sensor 216 (the sensitivity of which should be controlled) is hard wired, as at 217, to the transmitter 208.

In the event the door 201 has a glass panel or window 218, a fourth sensor 219 is provided to detect breakage of the glass panel 218; and this fourth sensor 219 is hard wired, as at 220, to the transmitter 208.

Figure 15:
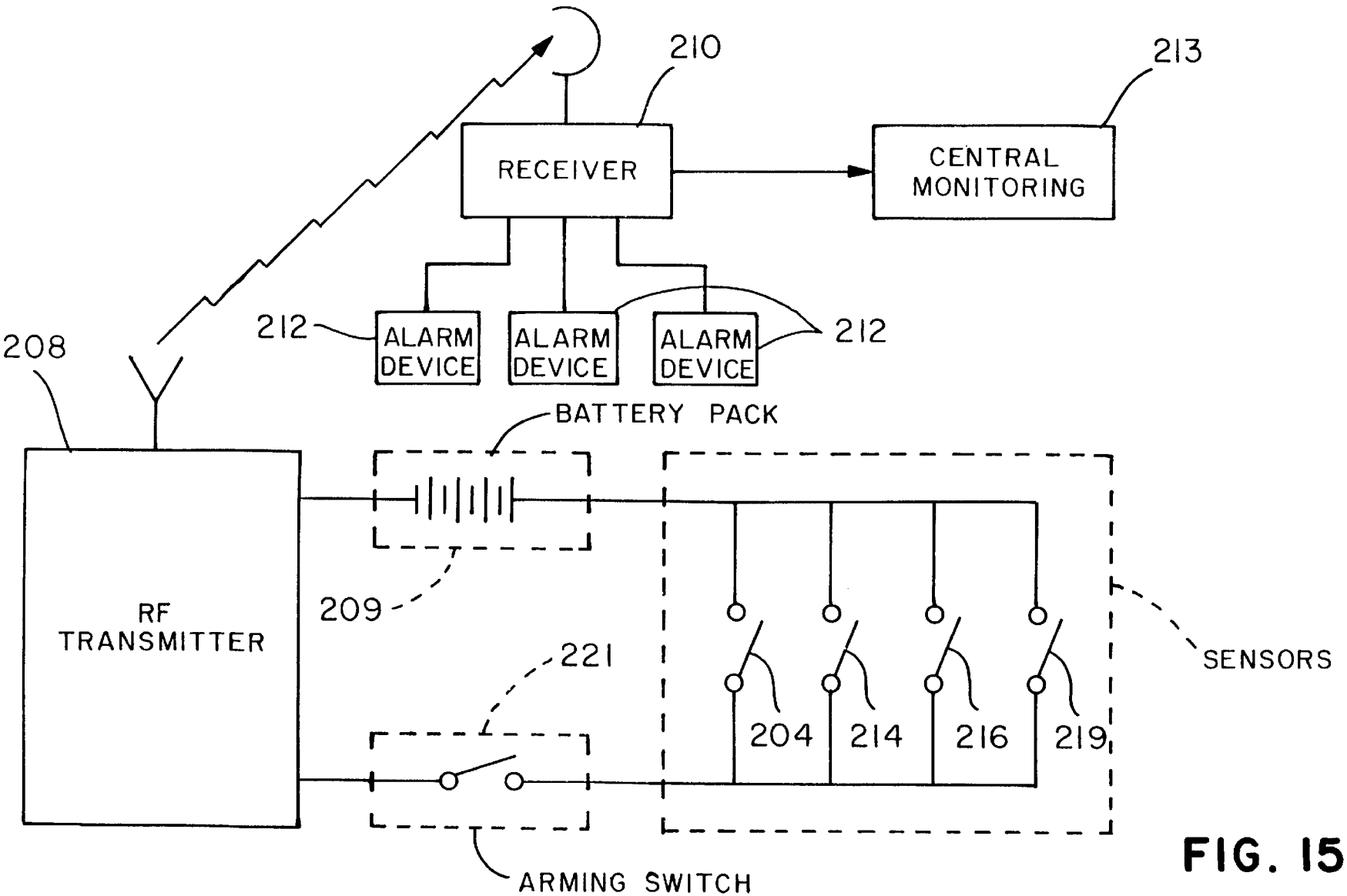
FIG. 15 is a schematic wiring diagram of a preferred embodiment of the present invention, corresponding to FIG. 14.

As shown in FIG. 15, all of the sensors 204, 214, 216 and 219, respectively, are wired in parallel; and any one sensor (or any number or all of the sensors) operate in the same manner to generate an alarm via the transmitter 208 and the remote receiver 210. Other sensors may be employed, if desired, consonant with the teachings of the present invention.

Moreover, if desired, all of the sensors, as well as the transmitter 208, may be encased in a housing which also includes the improved Z-Bar lock 10.

By way of example and without limiting the scope of the invention, the following components may be used in the preferred embodiment of the present invention:

| Component | Commercial Nomenclature |
|---|---|
| First sensor 204 | Ademco 966 door opening sensor |
| Third sensor 216 | Ademco 998P1 motion detector |
| Fourth sensor 219 | Ademco ASC 25 glass breakage sensor |
| Transmitter 208 | Ademco 5814 ultra small door/window RF transmitter |
| Receiver 210 | Ademco central station receiver |
| Alarm 212 | Ademco 747F self-contained siren |
| Alarm 212 | Ademco 710 series strobe warning light |
| Battery pack 211 | Ademco AD 12612 auxiliary power supply/battery charger |

With reference to FIG. 15, the sensors 204, 214, 216 and 219, respectively, are special purpose sophisticated electrical "switches" which turn ON in response to certain stimuli which they are designed to perceive. They are schematically located in parallel between an electrical line connected to the RF transmitter 208 and a line from the battery 209 which powers the RF transmitter 208. When one or more of these "switches" senses the condition which it is designed to perceive, the RF transmitter 208 receives battery power; and an RF signal emanates from the transmitter to the remote receiver 210. The receiver 210 then energizes the alarm device(s) 212 to which it is connected and sends a signal to the central monitoring station 213 (if the option of monitoring is selected by the owner).

The battery 209 which powers the RF transmitter 208 and the sensors can be physically located at any convenient place within the system. The battery compartment may also contain a charging means as well as a LED low battery indicator.

The switch 221 which "arms" the system is integral with the rotating lever 46 at the top of the latch plate assembly (of the improved Z-Bar lock 10). Schematically, the switch 221 interrupts or completes one of the conductors which connects the battery 209 to the RF transmitter 208. Arming the electronic security system is accomplished by the same motion of the pivotable handle 82 which places the mechanical system in the maximum security mode.

The door opening sensor 204 uses a two-part magnetic contact device 205, 206 located on the door 201 and the doorjamb 202, respectively. When the door 201 moves away from the jamb 202 as it begins to open, an electrical signal closes the circuit to the battery 209, thereby energizing the RF transmitter 208.

The Z-Bar security system sensor 214 is a touch-actuated switching device, such as a capacitance to ground switch. These are commonly used as elevator call buttons. This device is incorporated into the exterior surface of the Z-Bar lock 10 in the vicinity of the key hole, so that a finger or a hand-held key brought into contact with the Z-Bar lock 10 (when the system is armed) would trigger the alarm device (s) 212.

The glass breakage sensor 219 and the motion detecting sensor 216 operate in a similar manner. The sensitivity of the motion detector 216 must be adjusted, so that motion which is a substantial distance from the door 201 will not be detected. This will avoid nuisance tripping of the alarm system.

In conclusion, it is to be understood that the foregoing detailed description and the accompanying drawings relate to preferred embodiments of the invention. Various changes and modifications may be made without departing from the spirit and scope of the invention. Thus, by way of example and not of limitation, the supplemental locking arrangements in the latch plate may be implemented by a sliding member instead of a rotating cylinder, and the locking end of the latch member may be bifurcated with inwardly directed end portions instead of outwardly projected end portions. In addition, instead of a locking member 34 on the control knob shaft, the three portions of the Z-Bar assembly may be locked together by a separate mechanical locking mechanism.

The present invention is easily installed or retrofitted in a door which has an existing dead bolt. The existing locking cylinder and strike plate are removed and the present invention is mounted with the adapter 128 mounted in a detented portion 134 in the adapter plate 14 cooperating with the existing bore in the door jamb 70 which received the dead bolt in the existing device. The cylinder 120 of the present invention is placed in the existing bore in the door 24 and the rotary shaft 118 is engaged with the adapter 128 in the adapter plate 14. The base plate 18 of the mode selection assembly 44 is secured to the interior of the door 24 over the adapter plate 14 and the retrofit is completed.

Additionally, while the Z-Bar system is normally made of a metal, high-strength composite materials may be used for the latch member or other components of the lock. A composite may be the preferred material in situations calling for a lightweight lock. Furthermore, the present invention may have any of a variety of different types of mode indicators, such as digital displays or a system of lights. Moreover, the various components which must be mounted on the door may be mounted in a variety of ways that do not require screws, such as gluing or nailing.

Various alternatives to the spring pin are easily implemented. For instance, the internal spring 94 may be replaced with a piece of rubber or other resilient material. The spring pin base may be welded to the interior of the rotating cylinder without the need for a locking pin base mounting aperture 86. The locking pin may even be mounted on the outside of cylinder 72 with the locking head pin protruding inwardly when apertures 90 and 92 are in alignment in the secured position.

It should be further noted that the word "tube" as used in conjunction with the latch plate is not limited to a cylindrical cross-section. Indeed, "tube" may refer to a wide variety of cross-sections including, but not limited to, square, rectangular, oval, octagonal, triangular, and other shapes of cross-sections. Accordingly, the present invention is not limited to the specific embodiments shown in the drawings and described in the detailed description.

The preferred embodiment of the present invention, which combines the improved Z-Bar lock with the alarm system 203 (shown in FIGS. 14 and 15 and described herein), provides the maximum degree of mechanical and electronic protection for total perimeter security. The invention is fully compatible with existing state-of-the-art systems (wired or wireless) for a quick, convenient and relatively inexpensive retrofit of those existing systems. All of the electronic hardware is readily does not require highly-trained engineers.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In combination with a system to secure a latch member of a Z-Bar door latch system to a latch plate, wherein the Z-Bar door latch system provides (1) entry, (2) inspection, and (3) dead bolt modes of operation, and wherein the system to secure the latch member comprises:

a latch plate for mounting on a door frame;

a Z-Bar latch assembly for mounting onto an interior side of a door, the Z-Bar latch assembly including (1) a base plate for securing to an edge of said door, (2) an intermediate link pivotally connected to said base plate, and (3) a mode selection and latching assembly pivotally mounted to said intermediate link, said Z-Bar latch assembly further comprising a latch member;

said latch plate comprising a tube having a tube opening for receiving said latch member;

a sleeve having an opening, said sleeve being rotatably positioned inside of said tube of said latch plate;

a handle affixed to one end of said sleeve for rotating said sleeve to engage said latch member inside said sleeve in a secure position;

said latch plate further comprising a locking device which releasably locks said sleeve into said secure position, said locking device comprising a locking detent, a locking member, and a spring, said spring releasably holding said detent into engagement with said locking member in said secure position until said spring is compressed; and a latch assembly control mechanism to selectively lock and unlock said latch assembly from an exterior side of the door, said mechanism comprising a key-operated cylinder for mounting on said exterior of the door, a shaft connected at one end to said key-operated cylinder and a freely rotatable adapter connected to an opposite end of the shaft, wherein rotation of the handle in a first direction engages the sleeve in the secure position with the spring in the locking device urging the locking detent into engagement with the locking member such that the sleeve is prevented from rotating and movement of the latch member is prevented even with use of the key, and wherein rotation of the handle in an opposite second direction against the urging of the spring releases the engagement of the locking detent from the locking member such that the sleeve rotates and the key controls movement of the latch member such that the latch member may be disengaged from the sleeve;

an electronic alarm system having at least one sensor, thereby providing the maximum degree of mechanical and electronic security.

2. In combination with a system for pivotally securing a latch member to a latch plate mounted on a door frame, wherein said system comprises:

a latch plate comprising a tube having an opening for receiving said latch member;

a rotatable sleeve having a sleeve opening, said sleeve being positioned inside of said tube of said latch plate;

a handle affixed to one end of said sleeve for rotating said sleeve to engage the latch member inside said sleeve opening in a secured position; and said latch plate further comprising a locking system which releasably prevents said handle and sleeve from rotating relative to said tube in said secured position, wherein said latch member is prevented from being disengaged from said opening in said sleeve, said locking system comprising a locking detent, a locking member, and a spring, said spring selectively holding said detent into engagement with said locking member in said secured position until said spring is compressed, and an electronic alarm system having at least one sensor, thereby providing the maximum degree of mechanical and electronic security.

3. A combination as defined in claim 2, wherein said locking detent comprises a spring-loaded locking pin mounted within said tube, and said locking member comprises an aperture in said latch plate tube, a portion of said spring-loaded locking pin protruding through said aperture in said secured position, wherein manual pressure on said protruding locking pin compresses said spring and releases said locking system such that rotation of said handle disengages said sleeve from said latch member.

4. A combination as defined in claim 2, wherein:

said rotatable sleeve further includes a first locking pin aperture;

said latch plate tube further includes a second locking pin aperture; said locking member comprising said first and second apertures;

said first and second locking pin apertures being in alignment in said secured position; and said locking system comprises a spring-loaded locking pin mounted within said sleeve, said locking pin having a head which protrudes through both said first locking pin aperture and said second locking pin aperture when said sleeve is in said secured position, thereby preventing said sleeve from rotating relative to said latch plate tube, said locking detent comprising said locking pin head, wherein manual pressure on said protruding locking pin compresses said spring and releases said locking system such that rotation of said handle disengages said sleeve from said latch member.

5. A combination as defined in claim 2, wherein said locking system is a protrusion and slot system in which:

said latch plate tube has a first end and an opposite second end and a slot in said first end, said slot having a linear portion and at least one angular portion formed at an angle to the linear portion; wherein said detent comprises said protrusion and said locking member comprises said at least one angular portion of said slot, said spring being mounted within the second end of said tube in substantial juxtaposition to said sleeve to bias said rotatable sleeve in a direction toward said slot; and said rotatable sleeve further comprises said protrusion which mates with said slot, such that said protrusion aligns with and releasably engages with said at least one angular portion of said slot at said secured position, thereby locking the system into said secured position until said protrusion is disengaged from said at least one angular portion of said slot by downward movement of said handle to compress said spring and rotation of said handle to disengage said sleeve opening from said latch member.

6. The combination as defined in claim 5, wherein two angular portions are formed, one angular portion being on each opposite end of the linear portion of said slot, such that two secured positions are defined, one secured position preventing rotation of said sleeve and the other secured position keeping said sleeve in an unlocked position.

7. A combination as defined in claim 2, wherein said detent is a pin, said spring is mounted within said tube, and said locking member is an opening, wherein said spring tends to bias said pin into said opening, said sleeve being prevented from rotating relative to said tube when said pin is engaged with said opening, said pin becoming disengaged from said opening when said spring is compressed.

8. In combination with a system to secure a latch member of a Z-Bar door latch system to a latch plate, wherein the Z-Bar door latch system provides (1) entry, (2) inspection, and (3) dead bolt modes of operation, and wherein the system to secure the latch member comprises:

a latch plate for mounting on a door frame;

a Z-Bar latch assembly for mounting onto a door, the Z-Bar latch assembly including (1) a base plate for securing to an edge of said door, (2) an intermediate link pivoted to said base plate, and (3) a mode selection and latching assembly pivotably mounted to said intermediate link, said Z-Bar latch assembly further comprising a latch member;

said latch plate comprising a tube having a tube opening for receiving said latch member;

a sleeve having an opening, said sleeve being rotatably positioned inside of said tube of said latch plate;

a handle affixed to one end of said sleeve for rotating said sleeve to engage said latch member inside said opening in said sleeve in a secure position; and said latch plate further comprising a locking device to prevent the handle and sleeve from rotating, wherein the latch member is prevented from being disengaged from said opening in said sleeve;

an electronic alarm system having at least one sensor, thereby providing the maximum degree of mechanical and electronic security.

9. A combination as defined in claim 8, wherein said locking device comprises a locking detent, a locking member, and a spring mounted within said tube; said spring holding said detent into engagement with said locking member when said sleeve is in said secure position, to releasably maintain said sleeve into said secure position until said spring is compressed.

10. A combination as defined in claim 8, wherein:

said rotatable sleeve further includes a first locking pin aperture;

said latch plate further includes a second locking pin aperture;

said first and second locking pin apertures being in alignment in said secure position; and said locking device comprises a spring-loaded locking pin mounted within said sleeve, said pin comprising said spring, said locking pin having a head which protrudes through both said first locking pin aperture and said second locking pin aperture when said sleeve is in said secure position, said detent comprising said locking pin head, said locking member comprising said first and second apertures.

11. A combination as defined in claim 8, wherein said locking device is a protrusion and slot system in which:

said tube has a slot having an engagement portion;

said latch plate further comprises a spring biasing mechanism having a spring mounted within said tube in juxtaposition to an end of said sleeve opposite to the handle, said spring biasing mechanism biasing said sleeve in a direction toward said engagement portion of said slot; and said sleeve further comprises a protrusion which is in engagement with said slot, wherein movement of the handle in a first direction engages the protrusion in the engagement portion and rotates the sleeve in a first direction to prevent disengagement of the latch member from the opening in the sleeve and movement of the handle downwardly against the urging of the spring and in a second opposition direction, rotates the sleeve in an opposite second direction wherein the latch member may be disengaged from the opening in the sleeve.

12. A combination as defined in claim 8, wherein said locking device is a protrusion and slot system in which:

said tube has a slot having two spaced-apart engagement portions;

said latch plate further comprises a spring biasing mechanism having a spring mounted within said tube in juxtaposition to said sleeve, said spring biasing mechanism biasing said sleeve in a direction toward said engagement portions of said slot;

said sleeve further comprises a protrusion which is in engagement with said slot, such that movement of said handle to rotate said sleeve directs said protrusion opposite a selected engagement portion of said slot, said biasing mechanism putting said protrusion into said selected engagement portion;

wherein rotation of said handle in a first direction directs said protrusion into said selected engagement portion and prevents movement of said sleeve and opening of the system and rotation of said handle in a second direction removes said protrusion from said selected engagement portion and permits movement of said sleeve and opening of the latch system by movement of said mode selection and latching assembly.

13. In combination with a Z-Bar door security system providing (1) entry, (2) inspection, and (3) dead bolt modes of operation, which can be locked and unlocked from an exterior side of a door, and wherein the system comprises:

a latch plate for mounting on a frame of the door, said latch plate having an opening for receiving a latch member;

a Z-Bar latch assembly for mounting on an interior side of the door including (1) a base plate f,or securing to an edge of the interior side of the door in juxtaposition to said latch plate, (2) an intermediate link pivotally connected to said base plate, and (3) a mode selection and latching assembly pivotably mounted to said intermediate link;

said mode selection and latching assembly including a control knob, an extendable high strength latch member, and a camming mechanism to linearly advance said latch member into engagement with said opening in said latch plate, to implement the inspection and the dead bolt modes of operation;

a securing member which secures the base plate, the intermediate link and the mode selection and latching assembly together in a secured position while the latch member is extended into engagement with the latch plate in the dead bolt mode of operation; and a latch assembly control mechanism which may be mounted on the exterior side of a door to selectively lock and unlock said latch assembly from the exterior side of the door, and releasable connecting means between the latch assembly control mechanism and the securing member wherein the latch assembly control mechanism may be disconnected from the securing member;

an electronic alarm system having at least one sensor, thereby providing the maximum degree of mechanical and electronic security.

14. A combination as defined in claim 13, wherein said latch assembly control mechanism comprises a key-operated cylinder for mounting on the exterior of the door, a shaft connected at one end to said key-operated cylinder, and a freely rotatable adapter connected to an opposite end of the shaft for releasable connection and rotational engagement with said securing member, wherein rotation of a key rotates the securing member and produces concomitant rotation of the control knob.

15. A combination as defined in claim 14, wherein said latch assembly control mechanism further comprises an adapter plate which is mountable on the interior side of the door between the door and said base plate, the freely rotatable adapter being disposed in the adapter plate.

16. In combination with a Z-Bar door security system providing (1) entry, (2) inspection, and (3) dead bolt modes of operation, which can be locked and unlocked from an exterior side of a door, and wherein the system comprises:

a latch plate for mounting on a frame of the door, said latch plate having an opening for receiving a latch member;

a Z-Bar latch assembly for mounting on an interior side of the door including (1) a base plate for securing to an edge of the interior side of the door in juxtaposition to said latch plate, (2) an intermediate link pivotally connected to said base plate, and (3) a mode selection and latching assembly pivotally mounted to said intermediate link;

said selection and latching assembly including an extendable high strength latch member, and a camming mechanism to linearly advance said latch member into engagement with said opening in said latch plate, to implement the inspection and the dead bolt modes of operation;

a securing member which secures the base plate, the intermediate link and the mode selection and latching assembly together in a secured position while the latch member is extended into engagement with the latch plate in the dead bolt mode of operation;

a latch assembly control mechanism which may be mounted on the exterior side of a door to selectively lock and unlock said latch assembly from the exterior side of the door, wherein said latch assembly control mechanism comprises a key-operated cylinder for mounting on the exterior of the door, a shaft connected at one end to said key-operated cylinder, and an adapter connected to an opposite end of the shaft for rotational engagement with said securing member, and wherein said adapter includes prongs which rotationally engage with said securing member;

an electronic alarm system having at least one sensor, thereby providing the maximum degree of mechanical and electronic security.

17. In combination with a door and door jamb for locking the door to the door jamb, wherein:

a Z-Bar latch assembly is mounted on the door, the Z-Bar latch assembly including a base plate secured to an interior side of the door in juxtaposition to an adapter means secured to the interior side of the door, an intermediate link pivotably connected to the base plate, a mode selection and latching assembly pivotably connected to the intermediate link, the mode selection and latching assembly connected to and controlling a securing member, an extendable latch member connected to and controlled by the mode selection and latching assembly, a spring-loaded latch plate assembly releasably receiving and securing the latch member, and a key and cylinder mounted on an exterior side of the door, extending through the door to the adapter means wherein the key and cylinder permit opening and locking of the system from the exterior of the door, the latch plate assembly further having a movable handle to be placed in a selected first position or a second position, wherein in the first position, the latch member is releasably received in the latch plate assembly and may be opened and locked by the key and cylinder and in the second position, the latch member is secured in the latch plate assembly and opening and unlocking by the key and cylinder is prevented;

an electronic alarm system having at least one sensor, thereby providing the maximum degree of mechanical and electronic security.

18. In combination with a Z-Bar locking system cooperating with a door and a door jamb, the improvement which comprises a Z-bar latching assembly and an adapter means mounted on the door, the adapter means actuated by a key which respectively locks and releases the Z-Bar locking system externally of the door, the adapter means having a freely rotatable adapter and a securing member releasably engaged by the adapter, the securing member being connected with a latching member which releasably engages a latch plate assembly on the door jamb; and an electronic alarm system having at least one sensor, thereby providing the maximum degree of mechanical and electronic security.

19. In combination with a Z-Bar locking system cooperating with a door and a door jamb, the Z-Bar locking system having a base plate secured to an interior side of the door in juxtaposition to an adapter means secured to the interior side of the door, an intermediate link pivotally connected to the base plate, a mode selection and latching assembly pivotally connected to the intermediate link, an extendable latch member connected to and controlled by the mode selection and latching assembly, a latch plate assembly mounted on the door jamb, the latch plate assembly releasably receiving the extendable latch member, and the latch plate assembly having a spring-loaded locking detent to secure and release the latch member in the latch plate assembly;

an electronic alarm system having at least one sensor, thereby providing the maximum degree of mechanical and electronic security.

20. In combination with a Z-Bar latch assembly mounted on a door, having a base plate secured to an interior side, an intermediate link pivotally connected to the base plate, a mode selection and latching assembly pivotably connected to the intermediate link, and a latch plate assembly mounted on a door jamb, wherein the latching assembly is releasably connected to the latch plate assembly, an improvement comprising:

a key operated lock mounted on an exterior side of the door and connected by releasable means, through the door, to a control knob on the mode selection and latching assembly wherein rotation of a key produces concomitant rotation of the control knob to move a latch member of the latching assembly to engage and disengage the latch plate assembly such that the Z-Bar latch assembly may be locked and unlocked exteriorly of the door, and an electronic alarm system having at least one sensor, thereby providing the maximum degree of mechanical and electronic security.

21. The combination of claim 20, wherein the key operated lock has a shaft connected thereto, an adapter being formed on the shaft distal from the key operated lock, the adapter rotationally engaging a locking flange, the locking flange being connected to the control knob.

22. The combination of claim 20, wherein the latch plate assembly has manually selectable means therein to releasably retain the latch member such that the latch member may be unlocked by the key operated lock or unlocking of the latch member by the key may be prevented.

23. The combination of claim 22, wherein the means in the latch plate assembly to releasably retain the latch member is a latch plate tube having a first end, an opposite second end and a slot in said first end, said slot having a linear portion and at least one angular portion formed at an angle to the linear portion, the latch plate tube further having a tube opening for receiving the latch member;

a sleeve having an opening therein to receive the latch member, a first end and a second opposite end, the sleeve being rotatably positioned within the latch plate tube;

a spring being mounted within the second end of the latch plate tube in substantial juxtaposition to the second end of the sleeve to bias said rotatable sleeve in a direction toward said slot;

a handle affixed to the first end of the sleeve for rotating the sleeve to engage the latch member in the opening in the sleeve and to prevent removal of the latch member from the sleeve;

said rotatable sleeve further comprising a protrusion which mates with said slot when the handle is rotated against the urging of the spring such that said protrusion aligns with and releasably engages with said at least one angular portion of said slot at a secured position, thereby locking the system into the secured position until said protrusion is disengaged from said at least one angular portion of said slot and when the protrusion is engaged, the Z-Bar latch assembly is securely locked preventing unlocking with the key.

24. The combination of claim 22, wherein the means in the latch plate assembly to releasably retain the latch member is a latch plate tube having a first end, an opposite second end, a tube opening for receiving the latch member, and a first locking pin aperture, a sleeve having an opening therein to receive the latch member, a first end and a second opposite end, the sleeve being rotatably positioned within the latch plate tube, a handle being affixed to the first end of the sleeve for rotating the sleeve, a second locking pin aperture being formed in the sleeve, the first locking pin aperture in the tube being aligned with the second locking pin aperture in the sleeve, a spring-loaded locking pin mounted within the sleeve, the locking pin having a head which protrudes through both the first locking pin aperture and the second locking pin aperture when said sleeve is in a secured position, thereby preventing the handle and the sleeve from rotating relative to the latch plate tube even if the key is rotated, and wherein manual pressure on the protruding locking pin compresses the spring and releases the locking pin such that the handle may be rotated to align the opening in the sleeve with the latch member and to unlock the assembly by rotation of the key.

25. In combination with a door received within a door jamb, a Z-Bar latch assembly mounted on the inside of the door and having a three-position rotating cylinder operable by a key from outside of the door, the cylinder having three positions corresponding to "open", "viewing" and "closed" positions of the door, respectively, the Z-Bar latch assembly further having a pivotable plate operable in the "viewing" position of the door to enable the door to be opened partially, such that a visitor may be properly identified while providing good security against an intruder, a laterally-movable latch member operated by the rotating cylinder, a latch plate assembly mounted on the door jamb for receiving the latch member, and the latch plate assembly including manually-selectable means for preventing the door from being opened even if the rotating cylinder is turned by the key from outside of the door; and an electronic alarm system having at least one sensor, thereby providing the maximum degree of mechanical and electronic security.

26. The combination of claim 25, wherein the manually-selectable means is a handle affixed to the first end of a sleeve rotatably positioned within a tube on the latch plate assembly, the sleeve and the tube each having a respective opening therein to receive the latch member, a slot being formed in the tube, the slot having an angular portion formed thereon, a protrusion formed on the sleeve mating with the slot, the protrusion aligning with and releasably engaging the angular portion of the slot, a spring disposed in the tube adjoining a second opposite end of the sleeve and urging the sleeve toward the slot in the tube, wherein, manual rotation of the handle to engage the protrusion in the angular portion of the slot prevents the handle from rotating and prevents the latch member from disengaging from the sleeve such that rotation of the key to unlock the Z-Bar latch assembly is prevented, and manual rotation of the handle against the urging of the spring disengages the protrusion from the angular portion of the slot, rotating the sleeve to disengage the latch member such that rotation of the key unlocks the Z-Bar latch assembly.

27. In combination with a system cooperating with a door and a door jamb, wherein:

a Z-Bar latch assembly is mounted on the door, the Z-Bar latch assembly including a base plate secured to an interior side of the door in juxtaposition to an adapter plate secured to the interior side of the door, an intermediate link pivotally connected to the base plate, a mode selection and latch assembly pivotally connected to the intermediate link, wherein the Z-Bar latching assembly provides (1) entry, (2) inspection, and (3) deadbolt modes of operation, the mode selection and latching assembly having a control knob connected to and controlling a securing member, an extendable latch member connected to and controlled by the mode selection and latching assembly, a latch plate assembly mounted on the door jamb releasably receiving and securing the latch member, a freely rotatable adapter connected to the adapter plate, wherein the rotatable adapter may releasably engage and disengage the securing member, the adapter plate aligning the rotatable adapter with the securing member, a key operated cylinder mounted on an exterior side of the door and connected to the adapter plate and connected to the adapter wherein rotation of a key produces rotation of the adapter, such that in the entry mode, the key from the exterior and the control knob from the interior, rotate the adapter and the securing member to move the extendable latch member from the latch plate assembly such that the door may be opened, in the inspection mode, the control knob moves the extendable latch member to be received in the latch plate assembly, the adapter being disengaged from the securing member so that the key is prevented from controlling the Z-Bar latch assembly and the door may be partially opened for viewing while denying entry, in the deadbolt mode, the extendable latch member is securely received by the latch plate assembly and the securing member is engaged by the adapter to lock the door such that the key from the exterior, and the control knob from the interior, may unlock the system, and an electronic alarm system having at least one sensor, thereby providing the maximum degree of mechanical and electronic security.

28. The combination of claim 27, further comprising means to unreleasably secure the latch member to the latch plate assembly, wherein neither the key nor the control knob may open the door.

29. A perimeter security system, wherein the system includes at least one door received within a doorjamb, a lock assembly mounted on the inside of the door and having a three-position rotating cylinder operable by a key from outside of the door, the cylinder having three positions corresponding to "open", "viewing" and "closed" positions of the door, respectively, wherein in the "viewing" position of the door, the door may be opened partially, such that a visitor may be properly identified while providing good security against an intruder, a laterally-movable latch member operated by the rotating cylinder, a latch assembly mounted on the door jamb for receiving the latch member, the latch assembly including manually-selectable means for preventing the door from being opened, an alarm system including at least a first sensor for detecting when the door has been forced open by an intruder, the alarm system further including a transmitter responsive to the first sensor for generating an alarm signal, and a remote receiver for receiving the alarm signal from the transmitter.

30. The perimeter security system of claim 29, wherein the lock assembly comprises a Z-Bar latch assembly.

31. The perimeter security system of claim 30, wherein the Z-Bar latch assembly has a pivotable plate operable in the "viewing" position of the door to enable the door to be opened partially.

32. The perimeter security system of claim 30, wherein the Z-Bar latch assembly includes a latch plate assembly.

33. The perimeter security system of claim 29, wherein the first sensor for detecting when the door has been forced open by an intruder comprises a door opening sensor which uses a two-part magnetic contact device, one on the door and the other on the door jamb.

34. The perimeter security system of claim 29, further including a second sensor for detecting tampering of the lock assembly.

35. The perimeter security system of claim 29, further including a third sensor comprising a motion detecting sensor to detect movement within a certain distance of the door externally thereof.

36. The perimeter security system of claim 29, wherein the door has a window, and wherein a fourth sensor detects breakage of the window.

37. A perimeter security system, wherein the system includes at least one door received within a door jamb, a lock assembly mounted on the inside of the door and having a three-position rotating cylinder operable by a key from outside of the door, the cylinder having three positions corresponding to "open", "viewing" and "closed" positions of the door, respectively, wherein in the "viewing" position of the door, the door may be opened partially, such that a visitor may be properly identified while providing good security against an intruder, a laterally-movable latch member operated by the rotating cylinder, a latch assembly mounted on the door jamb for receiving the latch member, the latch assembly including manually-selectable means for preventing the door from being opened, an alarm system including at least a first sensor for detecting when the door has been forced open by an intruder, a second sensor for detecting tampering of the lock assembly, a third sensor for detecting movement within a certain distance of the door externally thereof, a transmitter responsive to any one of the three sensors for generating an alarm signal, and a remote receiver for receiving the alarm signal from the transmitter and thereby generating an alarm monitored by a central station, thereby providing the maximum degree of mechanical and electronic protection.

38. The perimeter security system of claim 37, wherein the lock assembly comprises a Z-Bar latch assembly.

39. The perimeter security system of claim 38, wherein the system includes a plurality of doors, each of which is provided with a Z-Bar latch assembly, and each of which is provided with said three sensors, thereby providing a total perimeter security system.

* * * * *